US006102219A

United States Patent [19]

Wang

[11] Patent Number: 6,102,219

[45] Date of Patent: Aug. 15, 2000

[54] COMBINATION STORAGE RACK

[76] Inventor: Wen-Tsan Wang, P.O. Box 82-144, Taipei, Taiwan

[21] Appl. No.: 09/276,643

[22] Filed: Mar. 26, 1999

[51] Int. Cl.[7] ..... A47B 47/00

[52] U.S. Cl. ..... 211/194; 312/111; 312/265.1

[58] Field of Search ..... 211/194, 180; 206/504, 508, 512; 220/1.6, 4.26–4.28, 4.33–4.34, 7, 9.1–9.4, 23.2–23.8, 229, 241, 668; 312/3–6, 107.5, 108, 109, 111, 293.3, 265.1, 265.5

[56] References Cited

U.S. PATENT DOCUMENTS

| | | | |
|---|---|---|---|
| 4,527,694 | 7/1985 | Bolt et al. | 312/183 |
| 4,685,571 | 8/1987 | Hoss | 206/521 |
| 4,974,386 | 12/1990 | Erikkson et al. | 312/111 |
| 5,211,290 | 5/1993 | Janus et al. | 220/9.3 |
| 5,238,139 | 8/1993 | Biscelgia | 220/7 X |
| 5,725,119 | 3/1998 | Bradford et al. | 220/7 |
| 5,897,180 | 4/1999 | Singer | 312/265.1 |

*Primary Examiner*—Daniel P. Stodola
*Assistant Examiner*—Jennifer E. Novosad
*Attorney, Agent, or Firm*—A & J

[57] ABSTRACT

A combination storage rack, which includes a plurality of storage units that can be connected in stacks by pins, and a plurality of bridge plates for connecting the storage units in pairs, wherein each storage unit includes a rectangular open frame, a cover plate covered on the open frame, the cover plate having two rows of first downward lugs with hook means and two second downward lugs, a collapsible shield suspended from the hooked portions and defining therein a plurality of compartments for keeping storage items, and a hanging rod between the second downward lugs for hanging things; the bridge plate has two downward lugs near its two opposite ends which holds a hanging rod for hanging things.

4 Claims, 5 Drawing Sheets

COMBINATION STORAGE RACK

BACKGROUND OF THE INVENTION

The present invention relates to a storage rack for holding storage items, and more particularly to a combination storage rack that can easily be set up and arranged in the desired form.

Regular home use storage racks or cabinets may be made of wood, plastics, or metal. These storage racks or cabinets are set up at factory or destination subject to the designed shape. Consumers cannot freely change the shapes or dimensions of these storage racks or cabinets.

SUMMARY OF THE INVENTION

It is the main object of the present invention to provide a combination storage rack that can easily be set up by the consumer and arranged in any of a variety of forms. According to one aspect of the present invention, the combination storage rack is comprised of a plurality of storage units, and a plurality of bridge plates for connecting the storage units in pairs, wherein each storage unit comprises a rectangular open frame, a cover plate covered on the open frame, the cover plate having two rows of first downward lugs with hook means and two second downward lug, a collapsible shield suspended from the hooked portions and defining therein a plurality of compartments for keeping storage items, and a hanging rod between the second downward lug for hanging things; the bridge plate has two downward lugs near its two opposite ends which holds a hanging rod for hanging things. According to another aspect of the present invention, the rectangular open frame of each of the storage units has a plurality of recessed pin holes symmetrically disposed at top and bottom sides such that the rectangular open frames of each two of the storage units can be connected in a stack by pins.

DETAILED DESCRIPTION OF THE PREFERRED EMBODIMENT

Figure 1:
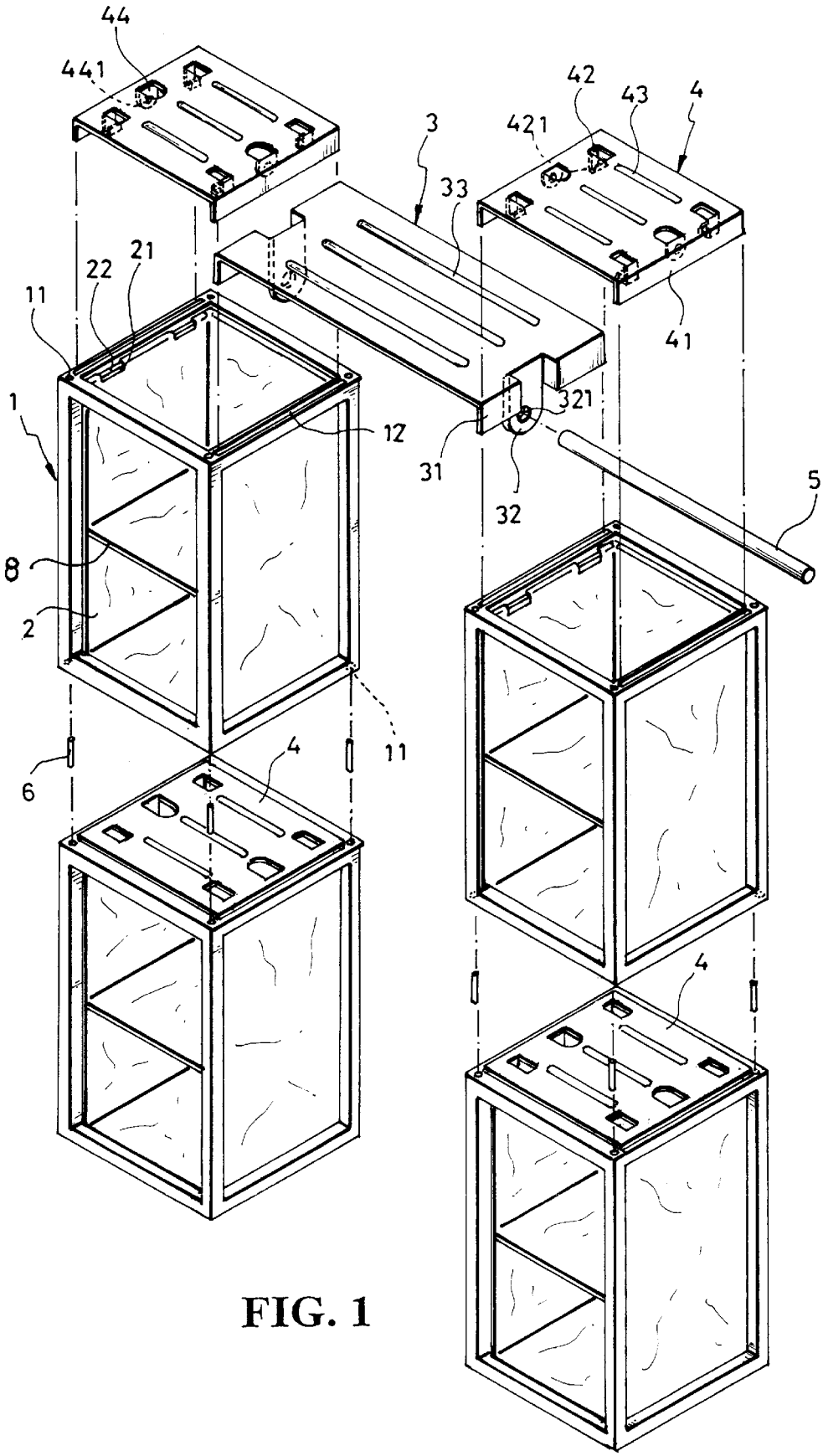
FIG. 1 is an exploded view of a combination storage rack according to one embodiment of the present invention.
Figure 2:
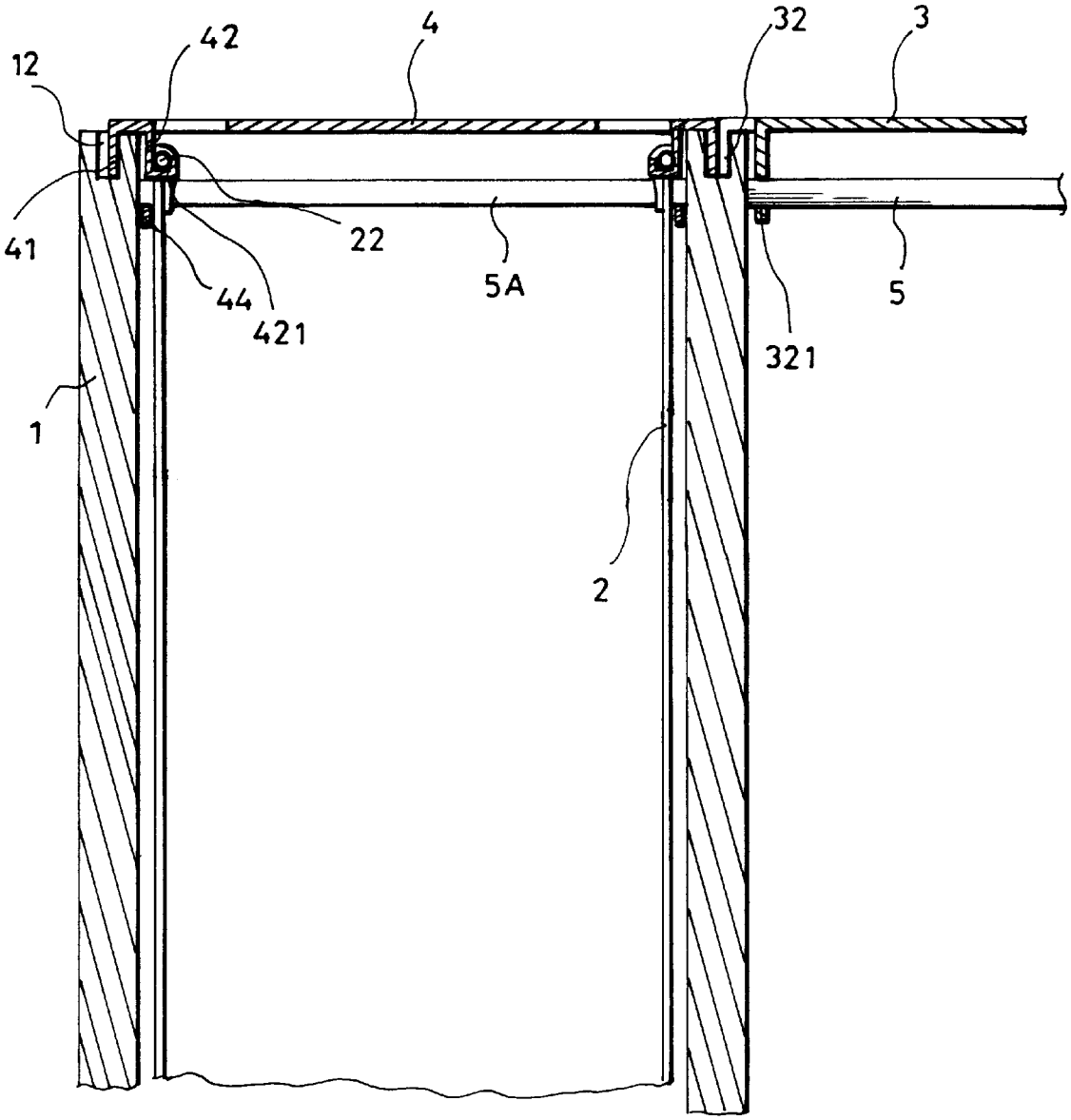
FIG. 2 is a sectional view in an enlarged scale of a part of the present invention, showing the cover plate covered on the rectangular open frame, the bridge plate fastened to the rectangular open frame.
Figure 3:
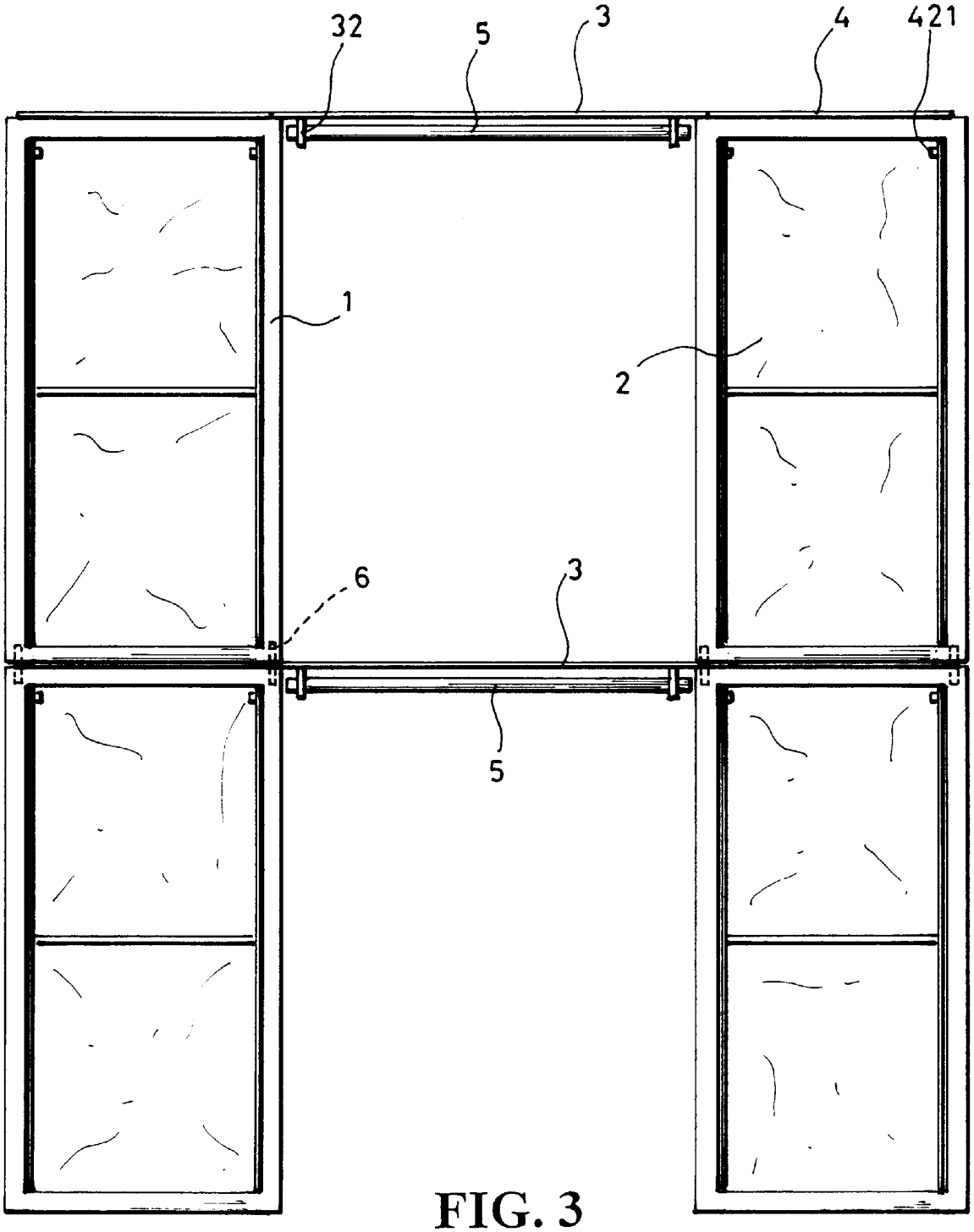
FIG. 3 is a plan view showing a combination storage rack set up according to the present invention.
Figure 4:
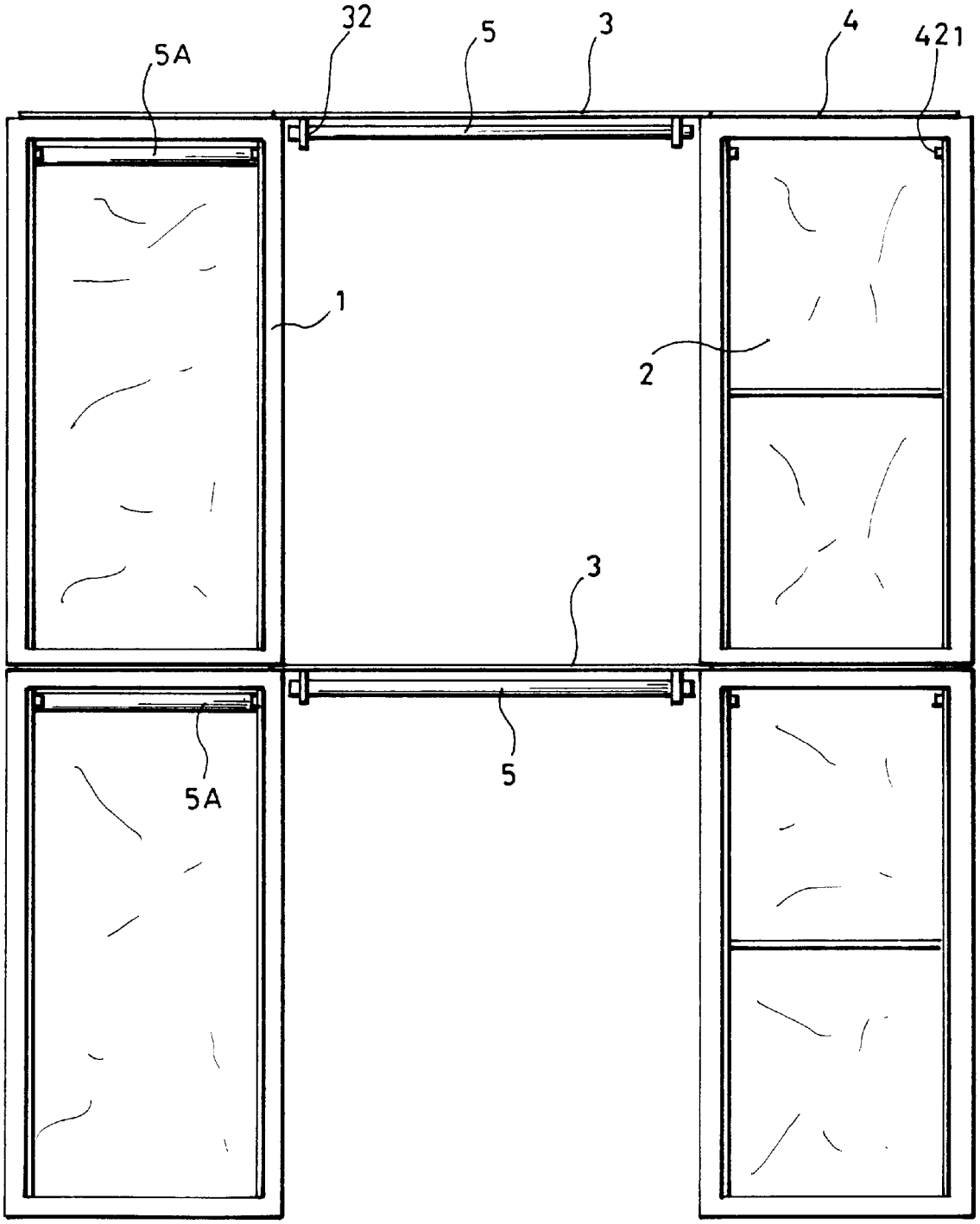
FIG. 4 is similar to FIG. 3 but showing hanging rods fastened to the cover plates in the storage units.

Referring to Figures from 1 through 4, a combination storage rack in accordance with the present invention is generally comprised of a plurality of storage units, at least one bridging plate 3, and a plurality of hanging rods 5 and 5A. Each storage unit is comprised of a rectangular open frame 1, a cover plate 4 covered on the rectangular open frame 1 at the top side, and a collapsible shield 2 suspended in the rectangular open frame 1 for holding storage items. A number of the storage units can be connected in a stack. The storage units can also be connected in pair by one bridging plate 3. The hanging rods 5 and 5A can be fastened to the at least one bridge plate 3 or the cover plates 4 in the storage units for hanging things.

The rectangular open frame 1 of each of the storage units comprises two parallel mounting slots 12 bilaterally disposed at its top side, a plurality of recessed pin holes 11 symmetrically disposed at its top and bottom sides. A number of the storage units can be connected in a stack by mounting pins 6 in the recessed pin holes 11 at the bottom side of the open frame 1 of one storage unit and the recessed pin holes 11 at the top side of the open frame 1 of another storage unit.

The cover plate 4 of each of the storage units is covered on the corresponding open frame 1 at the top, comprising two transverse coupling flanges 41 perpendicularly downwardly raised from two opposite sides thereof, two transverse rows of first downward lugs 42 formed integral therewith by stamping and arranged in parallel, each first downward lug 42 having a hooked portion 421, a plurality of longitudinal reinforcing ribs 43 which reinforce the structural strength of the cover plate 4, and a pair of second downward lugs 44, each second downward lug 44 defining a through hole 441 for mounting one hanging rod 5A for hanging things in the respective storage unit. The cover plate 4 is covered on the corresponding open frame 1 by inserting the transverse coupling flanges 41 of the cover plate 4 in the mounting slots 12 at the corresponding open frame 1.

The collapsible shield 2 of each of the storage units is made of flexible material (for example, canvas or plastic sheet material), defining with partition means 8 therein a plurality of compartments for keeping storage items. The collapsible shield 2 of each of the storage units comprises two transverse rows of loops 21 bilaterally disposed at the top, and two locating rods 22 respectively inserted into the rows of loops 21 and hung on the hooked portions 421 at the first downward lugs 42 at the cover plate 4 of the respective storage unit.

Each of the at least one bridge plate 3 comprises two transverse coupling flanges 31 perpendicularly downwardly raised from two opposite short sides thereof, two downward lugs 32 formed integral therewith by stamping at the two opposite short sides, each downward lug 32 having a through hole 321, and a plurality of longitudinal reinforcing ribs 33 which reinforce the structural strength of the bridge plate 3. The transverse coupling flanges 31 of each bridge plate 3 are inserted with the respective transverse coupling flanges 41 of the respective cover plates 4 in the respective mounting slots 12 at the open frames 1 of the corresponding two storage units. The width of the mounting slots in the rectangular frame of each storage unit is approximately equal to the combined width of one transverse coupling flange of the cover plate of each of the storage units and one transverse coupling flanges of the bridge plate. One hanging rod 5 can be fastened to the through holes 321 at the downward lugs 32 at each bridge plate 3 for hanging things.

Figure 5:
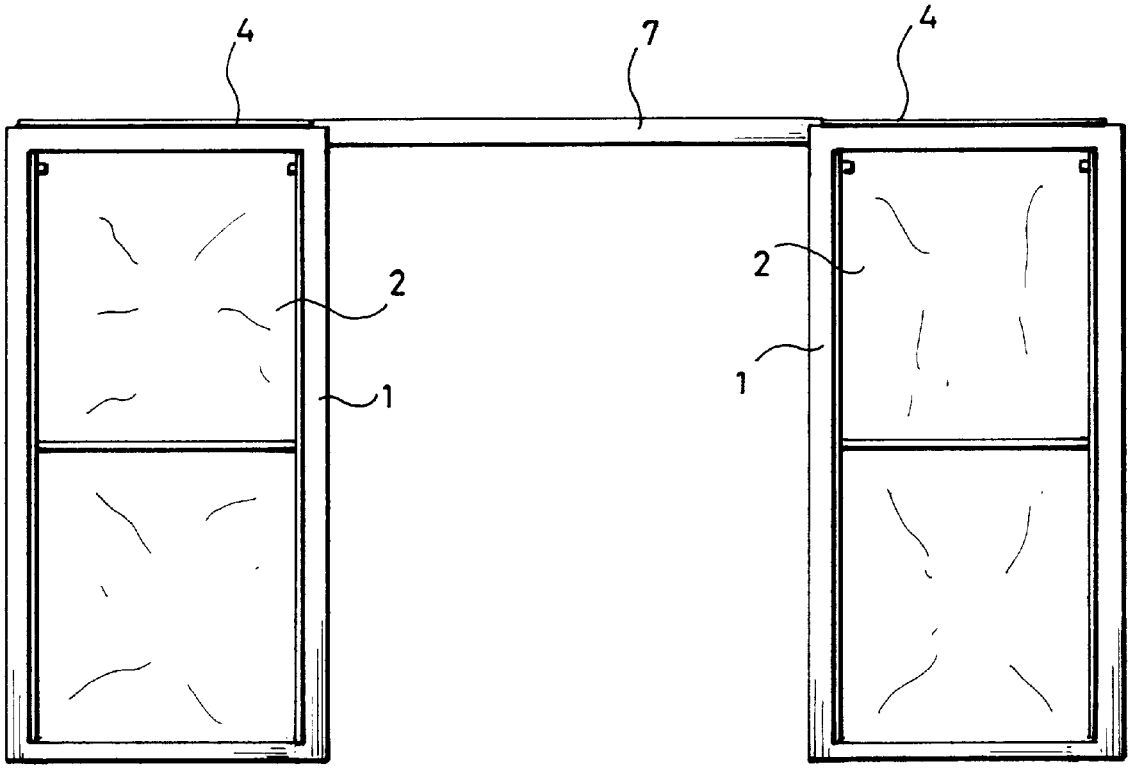
FIG. 5 is a plan view of an alternate form of the present invention.

Referring to FIG. 5, a beam 7 may be used instead of the aforesaid bridge plate 3 to connect two storage units in pair. When a beam 7 is used, it is securely fastened to the rectangular open frames 1 of the respective two storage units by screw bolts.

What the invention claimed is:

1. A combination storage rack comprising:

a plurality of storage units, said storage units each comprised of a rectangular open frame, a cover plate placed on said rectangular open frame at a top side, and a collapsible shield suspended in said rectangular open frame for holding storage items, said rectangular open frame comprising two parallel mounting slots bilaterally disposed at an open top side thereof, said cover plate comprising two transverse coupling flanges extending perpendicularly downwardly from two opposite sides thereof and respectively fastened to the mounting slots in said rectangular open frame, said cover further comprising two transverse rows of first downward lugs, said first downward lugs each having a hooked portion, and a pair of second downward lugs, said second downward lugs each defining a through hole, and a hanging rod fastened to the through holes in said second downward lugs for hanging items, a partition means within said rectangular open frame, which defines, with said collapsible shield, a plurality of compartments for storing storage items, said collapsible shield further comprising two transverse rows of loops bilaterally disposed at a top side thereof, and two locating rods respectively inserted into said transverse rows of loops and hung on the hooked portions in the first downward lugs on said cover plate;

at least one bridge plate for fastening said storage units in pairs, said at least one bridge plate each comprising two transverse coupling flanges extending perpendicularly downwardly from two opposite short sides thereof and adapted to be respectively fastened to one mounting slot in the rectangular open frame of each of two of the storage units, two downward lugs on the two opposite short sides, each downward lug having a through hole, and said hanging rod fastened to the through holes at the downward lugs of the respective bridge plate.

2. The combination storage rack of claim 1 wherein the rectangular open frame of each of said storage units comprises a plurality of recessed pin holes symmetrically disposed at top and bottom sides thereof for the positioning of pins, for enabling the rectangular open frames of each two of said storage units to be connected in a stack.

3. The combination storage rack of claim 1 wherein the width of the mounting slots in the rectangular open frame of each of said storage units is approximately equal to the combined width of one transverse coupling flange of the cover plate of each of said storage units and one transverse coupling flange of said at least one bridge plate.

4. The combination storage rack of claim 1 wherein the cover plate of each of said storage units and said at least one bridge plate each comprise a plurality of longitudinal reinforcing ribs.

* * * * *